US006836976B2

(12) United States Patent
Haugland

(10) Patent No.: US 6,836,976 B2
(45) Date of Patent: Jan. 4, 2005

(54) COLLAPSIBLE OUTDOOR FOOTWEAR AND BACKPACK

(75) Inventor: Solveig Laura Haugland, 910 Harrison Dr., Lafayette, CO (US) 80026

(73) Assignee: Solveig Laura Haugland, Lafayette, CO (US)

( * ) Notice: Subject to any disclaimer, the term of this patent is extended or adjusted under 35 U.S.C. 154(b) by 75 days.

(21) Appl. No.: 10/249,131

(22) Filed: Mar. 18, 2003

(65) Prior Publication Data

US 2004/0181968 A1 Sep. 23, 2004

(51) Int. Cl.[7] ..... A43B 3/24
(52) U.S. Cl. ..... 36/10; 36/4
(58) Field of Search ..... 36/4, 10, 55, 7.3

(56) References Cited

U.S. PATENT DOCUMENTS

| | | | | | |
|---|---|---|---|---|---|
| 2,440,563 | A | * | 4/1948 | Woyach | 36/7.3 |
| 4,489,509 | A | * | 12/1984 | Libit | 36/7.1 R |
| 4,599,810 | A | | 7/1986 | Sacre | 36/55 |
| 4,736,531 | A | | 4/1988 | Richard | 36/114 |
| 4,817,306 | A | * | 4/1989 | Bayer | 36/136 |
| 4,825,564 | A | * | 5/1989 | Sorce | 36/87 |
| 4,896,438 | A | | 1/1990 | DeBease | 36/7.1 R |
| 4,967,491 | A | * | 11/1990 | Plotkin | 36/7.1 R |
| 5,035,068 | A | | 7/1991 | Biasi | 36/3 R |
| 5,067,260 | A | * | 11/1991 | Jenkins, Jr. | 36/7.1 R |
| 5,127,170 | A | | 7/1992 | Messina | 36/105 |
| 5,729,915 | A | * | 3/1998 | Khoo et al. | 36/7.1 R |
| 5,784,737 | A | * | 7/1998 | Tsuji | 12/142 E |
| 5,881,708 | A | | 3/1999 | Kliot | 224/653 |
| 5,884,419 | A | * | 3/1999 | Davidowitz et al. | 36/11 |
| 5,964,047 | A | * | 10/1999 | Covatch | 36/55 |
| 6,035,555 | A | | 3/2000 | Pavelescu et al. | 36/14 |
| 6,195,914 | B1 | | 3/2001 | Otis | 36/11.5 |
| 6,298,583 | B1 | * | 10/2001 | Allen | 36/100 |
| 6,408,541 | B1 | | 6/2002 | Moretti | 36/12 |
| 6,412,193 | B1 | | 7/2002 | Chen | 36/14 |
| 6,457,266 | B1 | * | 10/2002 | Hsiao | 36/136 |
| 2002/0129519 | A1 | * | 9/2002 | Cahan | 36/100 |

* cited by examiner

*Primary Examiner*—Ted Kavanaugh
(74) *Attorney, Agent, or Firm*—Holland & Hart LLP; Francis A. Sirr, Esq.

(57) ABSTRACT

A collapsible article of footwear that is waterproof is provided. The collapsible article of footwear may include in combination a collapsible backpack for use in carrying sports footwear and other sports gear that is associated with an outdoor activity, while wearing the collapsible footwear.

12 Claims, 4 Drawing Sheets

COLLAPSIBLE OUTDOOR FOOTWEAR AND BACKPACK

FIELD OF THE INVENTION

The present invention is directed to outdoor equipment. More particularly, the present invention relates to collapsible footwear and a corresponding collapsible backpack for use in outdoor sports or activities.

BACKGROUND OF THE INVENTION

Many outdoor activities require the use of bulky, uncomfortable footwear. Such footwear, although functional for its intended purpose, may be uncomfortable for prolonged use, either before, during or after the activity. Such extended wear may produce foot fatigue in addition to soreness and cramping. Moreover, such footwear can be inconvenient for travel to and from the activity.

For example, a downhill ski boot is hard-shelled, highly constrictive and not at all conducive for wear outside of speeding down a mountain while secured in the bindings of a pair of skis. Simple tasks such as walking to and from a car, or moving around a cafeteria during a break in the day, can result in severe foot discomfort. Similar situations arise for hikers, ice skaters, in-line skaters, bicyclists, and certain pilots.

Walking to the base of a ski hill, or another starting point of the outdoor activity can be easily done in comfortable standard outdoor footwear. The problem, however, is what to do with the standard footwear once the sport footwear is worn. Some options are to store the standard footwear in a distant locker, or hope to store them in a backpack. Most options are inconvenient and/or uncomfortable and must be done while walking in the sport footwear. An outdoor weatherproof footwear that can be stuffed into a pocket would solve this problem.

"Apres-ski boots" of the 1970s addressed a similar problem of what to wear after skiing when one has returned to one's car or condo. However, these boots were not at all suitable for stuffing in one's jacket pocket, nor suitable for bringing along when camping or backpacking. Moreover, many types of indoor/outdoor slippers exist, but all have one or more disadvantages. For example, some are not flexible or crushable enough. Also, some do not have waterproof uppers. Most indoor/outdoor slippers look like slippers, which Is not appealing to outdoors-oriented people.

There are many different types, styles and varieties of footwear available to the outdoor enthusiast for post-activity wear. However, none have the combination of being weatherproof, compressible and sportily designed. It would be an improvement over the prior art to provide footwear for the outdoor enthusiast having an aesthetically pleasing design that is both weatherproof and compressible or collapsible.

In addition, it would be advantageous to provide a backpack for carrying the footwear associated with the activity while wearing the post-activity footwear. The backpack would be collapsible so as to fit comfortably in a small space, such as a pocket of a ski jacket, but durable enough to carry the many different varieties of heavy gear associated with the activity.

SUMMARY OF THE INVENTION

The foregoing and other features, utilities and advantages of the invention will be apparent from the following more particular description of preferred embodiments of the invention as illustrated in the accompanying drawings.

In accordance with one aspect of the current invention, a waterproof and collapsible article of footwear is provided. The collapsible article of footwear comprises an insole having one or more layers of insulating material wherein the insole provides protection between a user's foot and the elements. A sole pad is also provided that has a top face and a bottom face, wherein the top face of the sole pad supports the insole. The footwear also has an upper having an outer layer of material and an inner layer of material. The outer layer of material is waterproof and optionally it is breathable. In accordance with the invention, the upper collapses onto the sole pad to a thickness sufficiently small for convenient storage. The footwear also has a lining that contacts the insole and the upper that is constructed of a moisture wicking and insulating material. While the wicking/insulating characteristics of the lining are desirable, these characteristics are not required. For example, a stretch-vinyl lining can be used having small vents, or the lining can be formed of a smooth and an attractive material. Finally, the footwear preferably includes a waterproof sealing that connects the sole pad and the upper to produce a waterproof seam.

In accordance with another aspect of the invention, a combination collapsible article of footwear and collapsible backpack are provided. The backpack has a back section, a front section, a bottom section and a pair of shoulder straps. The shoulder straps are secured to the back section and are removably coupled to the bottom section. The backpack is constructed of a material that allows it to be compressed. In addition, the material has a tensile strength allowing the backpack to carry up to fifty pounds of gear. In use, these shoulder straps can be released from the backpack's bottom section, whereupon the loose ends of the shoulder straps can be connected to connections that are located at the top of the backpack, such that the backpack can then be used as a shoulder bag.

DETAILED DESCRIPTION OF THE PREFERRED EMBODIMENT

Currently, slippers are made to look and function like slippers. However, slippers are not immune to the elements, and typical slippers are not practical for outdoor use and wear. It is therefore desirable to provide an article of footwear for the outdoor enthusiast that provides the comfort and ease of use that is associated with a slipper. In addition, it would be beneficial to provide footwear that is comfortable when in use, and can be compressed for storage when not in use, particularly when storage space is in short supply. Moreover, a sporty, casual and comfortable indoor/outdoor article of footwear would also be appealing to non-sports-people who do not wear slippers, but want slipper-like functions in their footwear. Since footwear in accordance with this invention lends itself to wild and colorful designs, the footwear appeals to the teenage and 20's market, regardless of whether or not the footwear is worn as part of a sports activity.

According to the invention, footwear can be constructed in nearly unlimited styles, including slip-on styles that include elastic vents. Accordingly, the following embodiments illustrate examples of the invention. It should be understood by those skilled in the art that any number of materials and shapes similar to those described will function in a similar manner as that described, and therefore may be used interchangeably without departing from the intended function.

Compressible Waterproof Footwear

Figure 1:
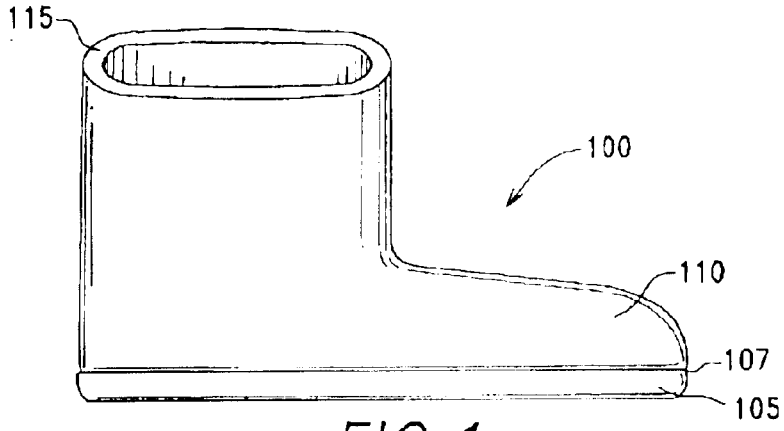
FIG. 1 is a side view of an embodiment of a collapsible article of footwear in accordance with the present invention.

FIG. 1 illustrates a perspective view of compressible or collapsible footwear 100 in accordance with the present invention. The overall design of collapsible footwear 100 is preferably ankle-high to ensure that snow and water does not spill over the top and onto a foot. Several styles are possible for footwear 100, such as pull-on, Velcro adjustable, openings at the side, or lace up the front in a manner similar to a boxing shoe. A thin and stretch stuff sack may be included with or secured to the side or to the tongue of footwear 100 (for example see 150 in FIG. 6). The footwear design provides a waterproof foot-enclosure that is warm and is protected from the elements, so that normal splashing and walking in snow and water does not allow moisture onto the foot.

Collapsible footwear 100 has a collapsible upper 110 that is secured to a sole pad 105, for example by a waterproof seam 107. The interior of upper 110 is lined with a lining 115. Waterproof seam 107 may not be required for footwear 100 that is intended for use Indoors, for example after a day of hiking.

Figure 11:
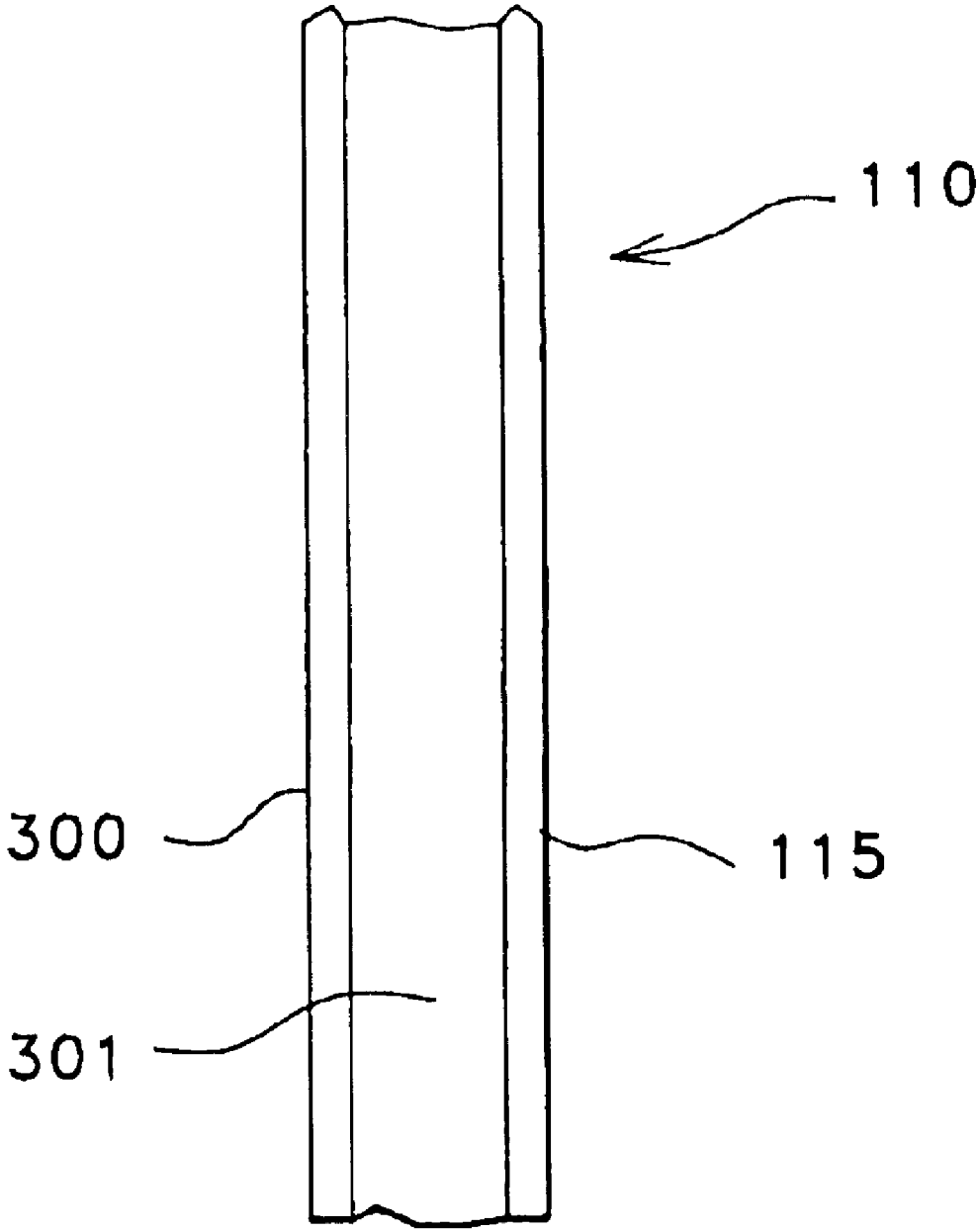
FIG. 11 is a cross sectional view of a portion of the collapsible upper of an article of footwear in accordance with the invention, this figure showing the three-layer construction and arrangement of the upper.

As shown in FIG. 11 upper 110 may be of a three-layer construction, including an outer material 300, a middle material 301 and an inner material 115, thus providing maximum protection from the elements. Upper 110 may also be of a two-layer construction that includes outer material 300 and inner material 115. In the illustrated embodiment, collapsible footwear 100 includes an upper 110 having a three-layer construction, comprising an outer water resistant material 300, an intermediate insulating material 301, and a inner fleece or wicking knit fabric 115. In the case of a lace-up embodiment (not shown), a tongue may or may not include all three of these layers. Again, the above-mentioned intermediate insulating layer 301 may not be required for footwear 100 that is intended for use in the summer.

Upper 110 may be constructed using styles that are in use for standard footwear, including, but not limited to, lace-up, slip-on, or zip-up. The materials used for upper 110 should not be bulky, unless footwear 100 is intended to fit only in a backpack and not in a pocket.

Preferably, but without limitation thereto, the outer layer material 300 of upper 110 should be waterproof and breathable. This can be achieved through use of breathable materials or nonbreathable materials such as vinyl that includes breathing vents. If collapsible footwear 100 is intended for use during winter activities, footwear 100 should be insulated with thin layer of insulating material.

In many cases, footwear 100 is intended to be worn for winter activities or activities in which water is present. As such, upper 110 is high enough to keep out snow or water at anticipated levels, without unreasonably reducing the compressibility of footwear 100. In one embodiment, footwear 100 should be at a minimum ankle-high for use after skiing. In another embodiment (not shown), if snow or water is anticipated to be significantly higher, upper 110 can be extend above the ankle, preferably with only the outer layer of fabric extending above the ankle, and without the insulating layer and the lining layer extending above the ankle.

Upper 110 may be secured to sole pad 105 using a waterproof seam 107. Seam 107 connects upper 110 to sole pad 105, whereupon upper 110 and sole pad 105 are sealed using a standard seam sealer or a product that creates a waterproof seam 107.

For footwear 100 intended to be worn during winter activities, lining 115 comes into contact with the wearer's foot, and lining 115 is preferably an insulating material that wicks moisture away from the foot, without unnecessarily adding to the bulk of footwear 100.

Figure 2:
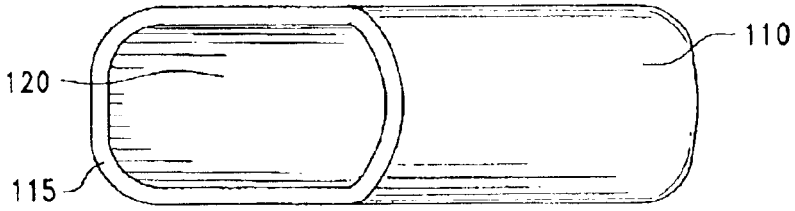
FIG. 2 is a top view of the FIG. 1 collapsible article of footwear.

FIG. 2 illustrates a top view of FIG. 1's compressible footwear 100. An insole 120 rests on top of lining 115. Insole 120 is intended to be worn during winter activities, and therefore should ensure that the wearer's foot is given reasonable protection from cold or other outdoor elements. That is, insole 120 provides additional protection from the cold and outdoor elements. Insole 120 may be manufactured from insulating materials such as is used In standard thin insoles, for example ⅜ inch polystyrene insulation sheets, insulating materials used as underlayments for prefabricated wood floors, and the like. The thickness of this insulation is chosen depending on the anticipated roughness of the walking surfaces. If footwear 100 in accordance with the invention does not include an insole 120, the materials that make up footwear 100 are chosen to reduce any surface roughness that a wearer might otherwise feel, without unduly increasing the bulk of footwear 100.

Figure 3:
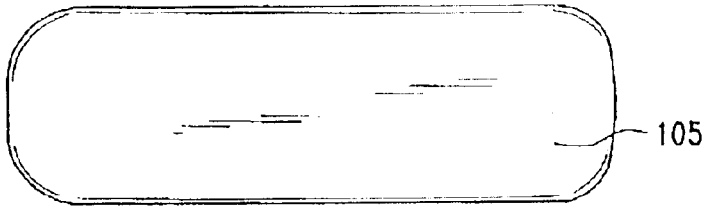
FIG. 3 is a bottom view of the FIG. 1 collapsible article of footwear.

FIG. 3 illustrates a bottom view of FIG. 1's compressible footwear 100. Particularly shown is sole 105. In an embodiment the sole 105 of footwear 100 should not exceed one-half inch in thickness, when not in use. Sole 105 of footwear 100 is intended for use during winter activities and therefore provides sufficient traction, water-resistance and security while walking on snow, ice, and other surfaces. A standard sole that is found on most indoor/outdoor slippers provides sufficient traction and water resistance in accordance with the present invention. Other materials, such as the material used for rubber floor mats in cars, also provide sufficient traction, water-resistance and protection from rough surfaces.

As stated above, sole 105 of footwear 100 is waterproof. Sufficient water-resistance can be achieved through use of rubber soles or other standard waterproof materials. Sole 105 of footwear 100 should ensure that the wearer's foot is provided reasonable protection from rough surfaces such as gravel. This can be achieved by varying the stiffness and thickness of sole 105, as well as by using thin insoles such as 120 of FIG. 2 that are formed of a moderately stiff fabric that protects the foot, but does not unreasonably reduce the ability of footwear 100 to fold or roll. Materials that offer this protection include stiff vinyl and cardboard, and if footwear 100 is intended for outdoor wear an insole 120 protects the wearer's feet.

Figure 4:
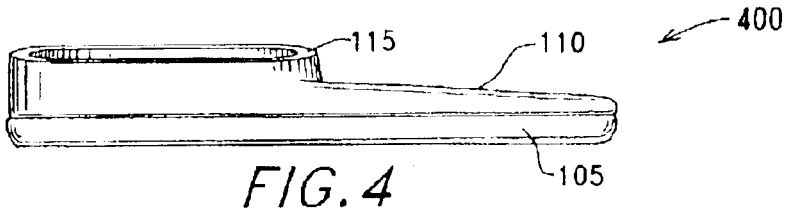
FIG. 4 is a side view of the FIG. 1 collapsible article of footwear in its collapsed state.

FIG. 4 shows an idealized perspective view of compressible footwear 100 in its compressed or collapsed state 400, it being understood that upper 110 will bend and fold in some unpredictable manner as it is compressed. In an embodiment of the invention the waterproof and collapsible article of footwear 100 collapses onto the sole to a thickness of from about two inches to about three inches.

Figure 5:
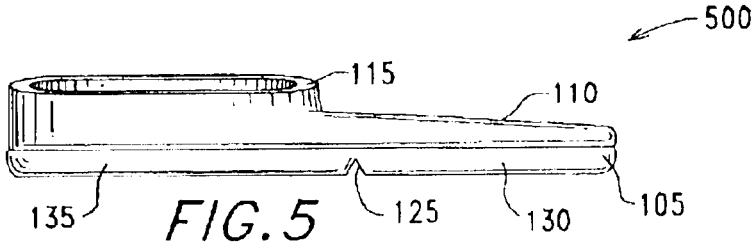
FIG. 5 is a side view of an embodiment of a collapsible article of footwear in accordance with the present invention wherein the article of footwear is shown in its collapsed state, this embodiment having a notch in the sole, this notch being located generally under the arch of the foot of a user.

FIG. 5 shows an idealized perspective view of a modification of compressible footwear 100 in accordance with the invention in its compressed state 500, it being understood that upper 110 will bend and fold in some unpredictable manner as it is compressed. In this modification sole 105 is provided with a notch 125 that extends the width of sole 105 and is located generally between the heel and the ball of a user's foot, that is notch 125 is located generally under the arch of a foot. Notch 125 allows the front portion 130 of sole 105 to be folded onto the back portion 135 of sole 105 (this folded position is not shown). As such, notch 125 assists in the folding of compressed footwear 500.

Figure 6:
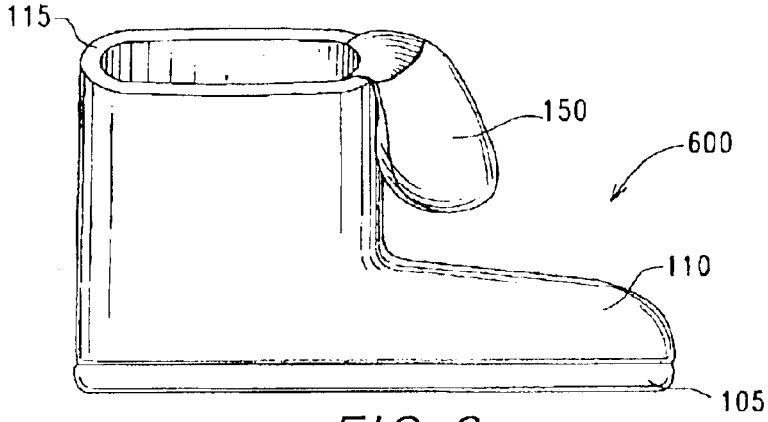
FIG. 6 is a side view similar to FIG. 1 wherein a stuff sack is attached to the collapsible article of footwear, this stuff sack being for us in covering the article of footwear when it is in its FIG. 4 or FIG. 5 collapsed state.

FIG. 6 illustrates compressible footwear 600 in accordance with the invention, as above-described relative to footwear 100, footwear 600 having a thin stuff sack 150 that is sewn onto the front portion of liner 115. In one embodiment, stuff sack 150 is a thin, French-seamed, stuff sack of roughly a paper-grocery-sack design that folds up and is inserted into a lined pocket (not shown) that is within an overlapping part of upper 110, or is inserted into a tongue (not shown).

Each article of footwear in accordance with this invention is easily compressed, via folding or other means, so as to fit into a pocket such as a ski jacket pocket. Aids to maintaining the footwear's compression can be added, such as a small storage sack or stuff sack. Such aids may also shield the footwear's dirty sole from the inside of a pocket.

Compressible Backpack

According to another aspect of the invention, a collapsible backpack for carrying sports gear is provided. The backpack provides exterior strap-means for carrying heavy sports gear such as ski boots, snowboard boots, hockey skates and ice skates, inline skates, bicycle shoes, hiking boots and the like in a compact package on the outside of the backpack. Since the backpack is compressible, the user may easily and comfortably store the collapsible backpack when it is not being used, such as storing in a pocket of a jacket, or in a small pocket of a larger backpack. In use, the backpack expands to provide sufficient room to accommodate heavy sports gear.

Figure 7:
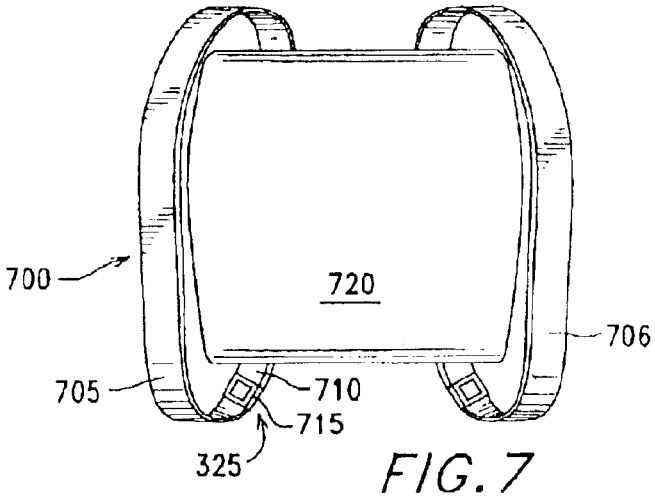
FIG. 7 is a front view of a backpack in accordance with the present invention.

According to FIG. 7, compressible backpack 700 is manufactured from a material that allows it to be folded, crumpled or balled-up into a small volume for storing. When expanded, the backpack's main storage compartment is sufficiently large enough to provide capacity for sports footwear, e.g., ski boots. In addition, the tensile strength of the backpack's material is sufficient to withstand strain that is placed upon it by the heavy sports gear. As a result, a compressible backpack 700 is provided for transporting heavy sports gear that occupies a limited amount of space when not in use, and is strong enough to carry heavy gear. In another aspect of the invention, a plurality of straps that are externally located on the back of the backpack are provided to carry items such as ski poles and skis.

In one embodiment of the invention, backpack 700 carries ski boots, skis and ski poles while a user is wearing the above-described collapsible footwear. Backpack 700 is made of compressible and collapsible fabric, so that when empty it can fit in a jacket pocket or the small pocket of a larger backpack. For example, backpack 700 may be manufactured using heavy netting, tulle, or nylon.

Figure 8:
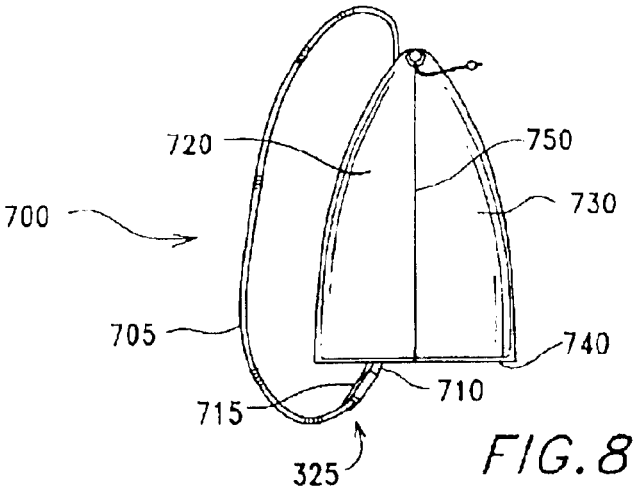
FIG. 8 is a side view of the FIG. 7 backpack.

As shown in FIG. 8, material pieces 720, 730 and 740 respectively form the front, back and bottom sections of backpack 700. Shoulder straps 705 and 706 of backpack 700 are secured to front section 720 and are removably coupled to bottom section 740. Shoulder straps 705, 706 are made of a webbing material that may not include padding, to thereby reduce bulk, since a skier is typically wearing a jacket or other clothing that provides padding. Backpack 700 may also include a stuff-sack such as 150 of FIG. 6 that is affixed to the material making up backpack 700.

Backpack 700 is designed to carry heavy sporting equipment that can weigh as much as fifty pounds. As such, reinforcement of backpack 700 may be provided by narrow webbing straps 750 that run vertically around backpack 700. This reinforcement significantly increases the tensile strength of the backpack material.

Backpack 700 may be worn as a backpack, or as an over-the-shoulder carry bag in the event that the wearer is already wearing a backpack. This conversion from a backpack to a shoulder carry bag is achieved through the use of plastic clips that connect straps 705 and 706 to the bottom of backpack 700, which plastic clips unclip so that the two strap-ends can be then attached at the top of backpack 700, such that backpack 700 can then be carried as a shoulder bag. Plastic clips 325 have a male end 710 and a female end 715. As shown in FIG. 7, the female end 710 is secured to a shoulder strap and the male end 710 is secured to the bottom 740 of backpack 700. Release of the male end 710 from the bottom 740 of backpack 700 enables the male ends 710 to be secured to female ends 715 that are secured to the top of backpack 700.

Figure 9:
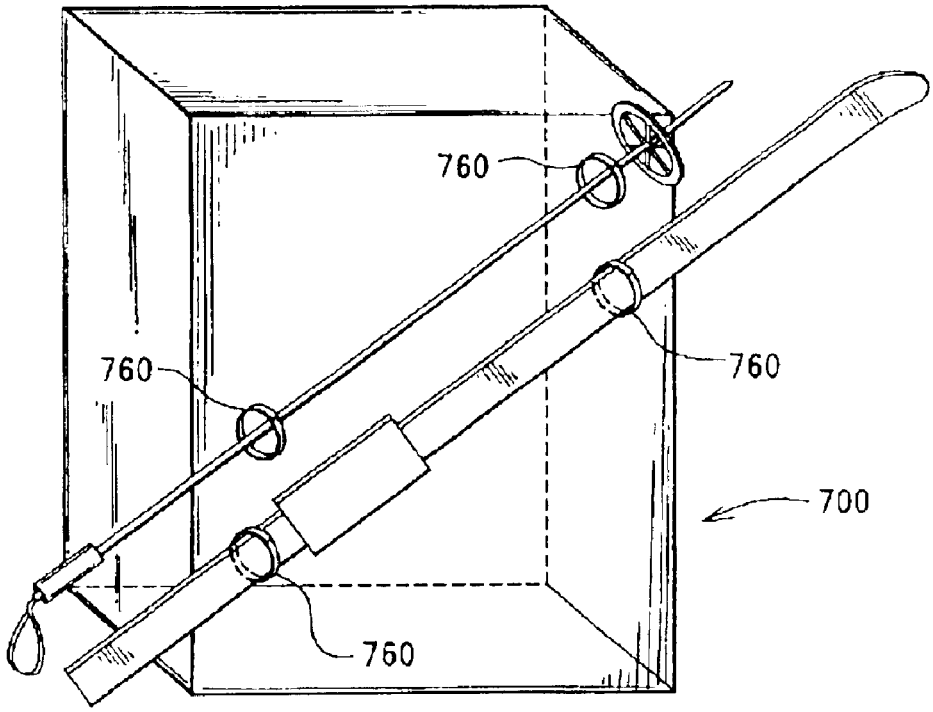
FIG. 9 is a back view of a backpack in accordance with the present invention, the back panel of the backpack including a number of exterior-located straps that can be closed around articles such as a ski and pole, to thus enable the backpack and its articles to be carried on the back of a user.

Backpack 700 provides the function of carrying not only ski boots but skis and poles as well. As shown in FIG. 9, skis and poles are carried at an angle by means of four webbing loops 760 that are attached to the outside of backpack 700. As illustrated, four webbing loops 760 are provided, however any number of loops may be used without diverting from the intended purpose of the invention. In one embodiment, the ends of webbing loops connect of close using Velcro or other closure mechanisms, thereby allowing skis and poles to be attached to the outside of the back panel 730 of backpack 700. It is intended that the selected loop-closure mechanism provide a loop of sufficient tightness to ensure that skis, poles and the like do not slip through loops 760 and fall.

Figure 10:
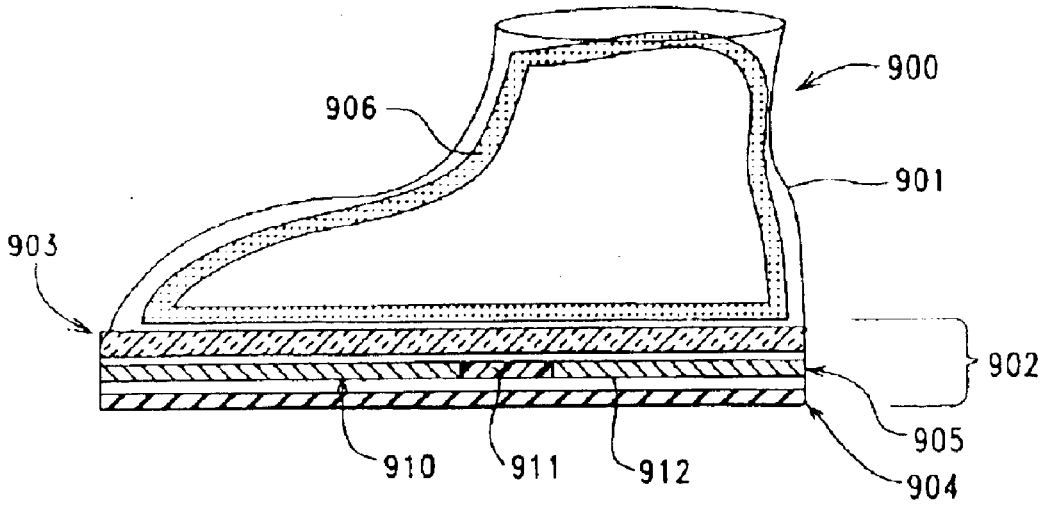
FIG. 10 is a side view of another embodiment of a collapsible article of footwear in accordance with the invention.

FIG. 10 illustrates a side view of another embodiment of a collapsible article of footwear 900 in accordance with the Invention wherein the upper 901 of footwear 900 is generally as above-described, upper 901 including an internal wicking layer 906 that generally surrounds the foot of a user.

FIG. 10 provides an exploded view of the three-layer sole portion 902 of footwear 900. Sole portion 902 includes (1) an insulating and/or padded insole layer 903 that is relatively flexible, (2) a bottom or external sole layer 904 that is relatively flexible and is preferably both water-proof and skid-proof, and (3) a three-piece layer 905 that lies intermediate layers 903 and 904.

Intermediate three-piece layer 905 is made up of (1) a front-portion 910 that is formed of a relatively rigid rubber or plastic, (2) a mid-portion 911 that is formed of a relatively flexible foam or rubber, and (3) a rear-portion 912 that is formed of a relatively rigid rubber or plastic. As a result, three-piece layer 905 can be bent or folded about its mid-portion 911.

Front-portion 910 is located generally under the ball of a user's foot, mid-portion 911 is located generally under the arch of a user's foot, and rear-portion 912 is located generally under the heel of a user's foot, and the three portions 910, 911, 912 of layer 905 physically abut to form one continuous layer 905.

While the thickness of the three layers 903, 904 and 905 is not critical to the invention, an example thickness of middle layer 905 is about ¼th inch. In addition, while the heel-to-toe length of flexible mid-portion 911 is not critical to the invention, an example length of flexible mid-portion 911 is from about 1 inch to about 2 inches.

In its collapsed state footwear 900 appears much as is shown in FIG. 4, and footwear 900 may include stuff sack 150 shown in FIG. 6.

While the invention has been particularly shown and described with reference to a preferred embodiment thereof, it will be understood by those skilled in the art that various other changes in the form and details may be made without departing from the spirit and scope of the invention.

What is claimed is:

1. A waterproof and collapsible article of footwear, comprising:

an internal, thin, and flexible and foldable insole having one or more layers of insulating material;

an external, flexible and foldable sole pad having a top face and a bottom face opposite to said top face, said top face of said sole pad supporting said insole, said sole pad having a construction and arrangement providing protection from rough surfaces that are traversed by said article of footwear;

a three-layer collapsible upper having an outer layer of flexible material, a middle layer of flexible material and an inner layer of flexible material, said outer layer of material being both waterproof and breathable, and said inner layer of material being both moisture wicking and insulating;

a waterproof seal securing said sole pad to a bottom portion of said upper, to thereby form a unitary article of footwear that contains said insole, an inner surface of said unitary article of footwear comprising said insole and said inner layer of material; and said three-layer upper being collapsible onto said insole, and said insole and sole pad being foldable.

2. The article of footwear of claim 1, wherein said outer layer of material comprises vinyl having breathing vents.

3. The article of footwear of claim 1, wherein said sole pad is waterproof.

4. The article of footwear of claim 1, wherein said sole pad does not exceed about ½ inch in thickness.

5. The article of footwear of claim 1, further comprising a stuff-sack secured to an upper portion of said upper, said stuff-sack for surrounding said article of footwear in a collapsed state of said article of footwear.

6. The article of footwear of claim 1, wherein said upper collapses onto said sole pad to a thickness of no more than about two inches.

7. A waterproof and collapsible article of footwear comprising:

a thin and foldable insole having one or more layers of insulating material that provide protection from the elements;

a sole pad having a top face and a bottom face opposite to said top face, said top face of said sole pad supporting said insole, said sole pad being flexible and foldable, and said sole pad having a construction and arrangement providing protection from rough surfaces that are traversed by said article of footwear;

a collapsible upper having a flexible outer layer of material and a flexible inner layer of material, said outer layer of material being waterproof and breathable, said inner layer being moisture wicking and insulating, and said upper being collapsible onto said sole pad; and a waterproof seal securing a bottom portion of said sole pad to said upper in a manner to form said sole pad and said upper into and unitary article of footwear that includes said insole, and wherein an inner surface of said unitary article of footwear comprises said insole and said inner layer of material.

8. The article of footwear of claim 7, wherein said outer layer comprises vinyl having breathing vents.

9. The article of footwear of claim 7, wherein said sole pad is waterproof.

10. The article of footwear of claim 7, wherein said sole pad does not exceed about ½ inch in thickness.

11. The article of footwear of claim 7, further comprising a stuff sack secured to an upper portion of said upper, said stuff sack for surrounding said article of footwear in its collapsed state.

12. The article of footwear of claim 7, said upper collapses onto said sole pad to a thickness of no more than about 2 inches.

* * * * *